US006003667A

United States Patent [19]

Barnett et al.

[11] Patent Number: 6,003,667

[45] Date of Patent: Dec. 21, 1999

[54] WIRE STORING AND DISPENSING PACKAGE

[75] Inventors: David H. Barnett, Fort Wayne; David B. Camillo, Lafayette, both of Ind.

[73] Assignee: Essex Group, Inc., Fort Wayne, Ind.

[21] Appl. No.: 08/995,819

[22] Filed: Dec. 22, 1997

Related U.S. Application Data

[62] Division of application No. 08/567,253, Dec. 5, 1995, Pat. No. 5,704,479.

[51] Int. Cl.[6] ..... B65D 83/00; B65H 55/00

[52] U.S. Cl. ..... 206/396; 206/409; 206/416; 242/171; 242/588.6

[58] Field of Search ..... 206/389, 395–397, 206/403–405, 408, 409, 413–416; 242/170, 171, 128, 129, 588.3, 588.6; 229/178

[56] References Cited

U.S. PATENT DOCUMENTS

| | | | |
|---|---|---|---|
| 3,332,546 | 7/1967 | George | 206/395 |
| 3,587,840 | 6/1971 | Hultberg | 206/395 |
| 3,693,784 | 9/1972 | Holmes | 206/409 |
| 4,151,914 | 5/1979 | Blatt | 206/395 |
| 4,373,687 | 2/1983 | Zicko | 206/409 |
| 4,444,313 | 4/1984 | Tyson | 206/397 |
| 4,645,108 | 2/1987 | Gavin et al. | 206/395 |
| 5,484,082 | 1/1996 | Casper et al. | 206/395 |
| 5,522,561 | 6/1996 | Koyamatsu et al. | 206/409 |

*Primary Examiner*—Paul T. Sewell
*Assistant Examiner*—Luan K. Bui
*Attorney, Agent, or Firm*—Rader, Fishman & Grauer PLLC

[57] ABSTRACT

An improved wire and cable packaging system for use with a spool wound with wire rotatable about a spiral-wrapped paper tube includes a container and a unitary insert, disposable in the container, both made of cardboard. The container includes a pair of retaining flaps and a pay-out slot for dispensing the wire. The insert is adapted to fit inside the container and is provided for receiving and supporting the tube when assembled. The insert includes a base with a pair of end walls extending vertically from opposing ends of the base. The end walls each having a support flap extending therefrom that is foldable about bend lines to a vertical position, adjacent the end walls, for improving support strength. The insert includes a pair of support flutes centrally formed about each bend line to define a cradle for receiving the tube. The retaining flaps of the container also have a flute for engaging the tube when the retaining flaps are moved from an open position to a closed position to thereby hold the tube and the insert in place.

5 Claims, 4 Drawing Sheets

WIRE STORING AND DISPENSING PACKAGE

This application is a division of application Ser. No. 08/567,253, filed Dec. 5, 1995, now U.S. Pat. No. 5,704,479.

BACKGROUND OF THE INVENTION

1. Field of the Invention

This invention relates to an improved packaging system for storing, transporting, and dispensing wire or cable.

2. Related Art

Wire shipping and dispensing boxes are well-known. Particularly, wire and cable packaging designers have focused their efforts on providing a package that is easy to use by an installer of the wire. Thus, there has been much investigation in the art relating to techniques for solving this problem of easily dispensing the packaged wire or cable—the so-called payoff problem. Initially, the payoff problem solution was separate from the packaging. For example, for wire shipped on spools, the installer had to purchase or rent payoff equipment that allowed the spool to turn freely while the installer pulled wire through a conduit, or the like. The industry responded with the development of the so-called "knock-out" carton. The "knock-out" carton eliminated the need for separate payoff equipment, but had the undesirable tendency to allow the wire to twist during installation, causing a tangle which could not be pulled through the conduit. Others have improved upon the "knock-out" carton to eliminate the above-mentioned twisting problem; however, such designs introduced another problem—in those designs, the wire had a tendency to tangle inside the box during payoff.

An improvement over these early systems was the introduction of a so-called spool-in-a-box design. The general operation of these designs permit the spool to spin inside the box, thus negating the need for external payoff equipment. Such a package has the benefit of reducing the number of different packages stocked by a distributor or contractor. Further, the spool-in-a-box designs are flexible. The wire or cable contained therein may be paid out directly using the package itself, or, the spool may be removed from the package and placed in traditional racks or payoff equipment, if desired.

However, conventional spool-in-a-box designs are not without their drawbacks. In particular, conventional designs have employed a great variety of material in their construction, thus increasing costs, weight, and complicating recyclability. For example, one conventional design uses plastic inserts to support the spool for rotation, which are expensive, require special tooling and molding equipment, and are likely provided by a source other than the wire container supplier itself, thus requiring coordination among multiple vendors. Others in the art have further used a variety of wood, and hardboard in their designs. In addition to the foregoing deficiencies with respect to weight, cost, and recyclability, the conventional designs have also often been found lacking in performance.

Accordingly, an improved wire and cable storing and dispensing package is needed that minimizes or eliminates one or more of the problems as set forth above.

SUMMARY OF THE INVENTION

In accordance with the present invention, an improved wire and cable packaging system is provided that is suitable for use with a spool wound with wire rotatable about an axle.

The system includes a container and a foldable support. The container is provided for mechanical protection and includes a pair of top retaining flaps and a payout slot in a lower portion of a sidewall for dispensing the wire. The support is, in a preferred embodiment, disposed inside the container and is provided for receiving and supporting the axle upon which the spool will rotate. The retaining flaps of the container each have a flute or notch corresponding to the shape and size of the axle so that when the retaining flaps are moved from an open position to a closed position to close the container, the flaps engage the axle. This engagement holds the axle and the support firmly in place, thus providing a sturdy package for improved wire payoff.

In a preferred embodiment, the support takes the form of a unitary cardboard insert having a base with a pair of end walls extending vertically from opposing ends of the base. Each vertical end wall has a support flap extending therefrom that is foldable about bend lines to a vertical position, which is next to the vertical end wall, for improving support strength. The insert further includes a support flute or notch centrally formed about each bend line to define a cradle for receiving the axle. The container and the axle are also formed from paper or paper products to thereby enhance recyclability, reduce weight and increase cost effectiveness of the system.

These and other advantages, features and objects of the present invention will become apparent to one of ordinary skill in the art from the following detailed description and, accompanying drawings illustrating features of the invention by way of example, but not by way of limitation.

DETAILED DESCRIPTION OF THE PREFERRED AND ALTERNATE EMBODIMENTS

Figure 1:
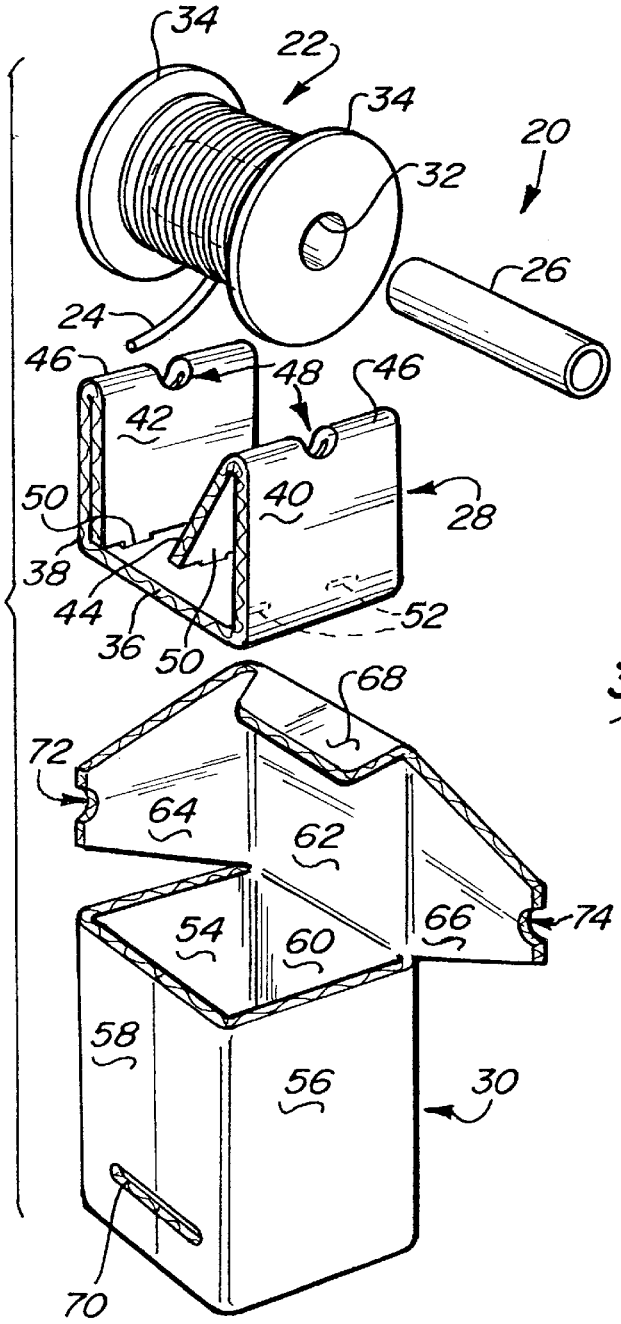
FIG. 1 is perspective exploded view of an embodiment in accordance with the present invention, partially assembled, which incorporates features of the invention.

Referring now to the drawings wherein like reference numerals are used to identify identical components in the various views, FIG. 1 illustrates an embodiment of the present invention—wire package system 20. System 20 includes a spool 22 wound with wire 24, an axle, such as a spiral-wrapped paper tube 26, means, such as insert 28, for receiving and supporting tube 26, and a container 30 for providing mechanical protection for the spool and wire.

Spool 22 may be formed of easily-recyclable high impact polystyrene, and, in the preferred embodiment, is of a standard size: 10.5 F×6.5 T×3.5 D. It should be appreciated, however, that the preferred embodiment may be easily adaptable to accommodate other sized spools. The spool includes a centrally-disposed through-bore 32 sized to accommodate tube 26, and flanges 34 for retaining wound wire 24. It should be understood that the term "wire" is being used in a generic sense, and is intended to encompass cable, and other types of wound material. Further, although the preferred embodiment uses a thin walled tube, any type of axle may be used, whether solid or hollow, and remain within the spirit and scope of the present invention.

Insert 28 is, in the preferred embodiment, unitary and may be formed using two-layer, triple-faced corrugated boxboard. Insert 28 includes a base portion 36, a pair of end walls 38 and 40 extending vertically from opposing ends of base 36, and a pair of support flaps 42 and 44 extending from vertical end walls 38 and 40, respectively. Support flaps 42, and 44 are foldable about bend lines 46 to a vertical position for improving the support strength of insert 28. Support flap 42 is illustrated in the vertical position, while support flap 44 is illustrated in a partially-folded position. Insert 23 further includes a pair of support flutes or notches 48 centrally formed about each bend line 46 to define a cradle for receiving tube 26. Notches 48 are made by forming a flute through the cardboard blank about the center of each bend line 46 so that when the insert is folded, the notches are formed thereby.

Support flaps 42, and 44 each include a pair of tabs 50 extending from a free end thereof. In addition, base 36 includes a corresponding pair of recesses 52 for each set of tabs such that when support flaps 42 and 44 are folded to the vertical position, the tabs 50 are received in recesses 52 for holding the support flaps in the vertical position.

Container 30 is preferably formed from a unitary blank of boxboard of an appropriate crush-resistance (e.g. 275 lb. burst rating), and includes opposing sidewalls 54, and 56, opposing sidewalls 58, and 60, a top panel 62, a pair of trapezoidal-shaped retaining flaps 64, and 66, and a locking flap 68. Although omitted for clarity, sidewall 58 includes a locking tab extending from a top edge thereof, and locking flap 68 includes a corresponding locking slot formed adjacent the locking flap 68/top panel 62 bend line so that when the container is closed, the tab/slot combination performs its conventional function to secure the top closed. Each of the sidewalls 54, 56, 58 and 60 include a bottom flap extending therefrom (not shown) which may be folded to form the bottom of container 30 in a manner well-known and conventional in the art. Container 30 may also have one or more elongated slot-shaped handle openings formed therein for the installer's convenience. Sidewall 58 also includes a payout slot 70 for dispensing wire 24.

Retaining flaps 64 and 66 have retaining flutes or notches 72, and 74, respectively, formed on a free end thereof. The notches 72, and 74 are sized and shaped to correspond to the size and shape of tube 26, and are provided for engaging tube 26 when retaining flap 64 and 66 are moved from an open position (as shown in FIG. 1) to the closed position (as shown in FIG. 2, and as best shown in FIG. 3) to thereby hold tube 26 and insert 28 in place.

Figure 2:
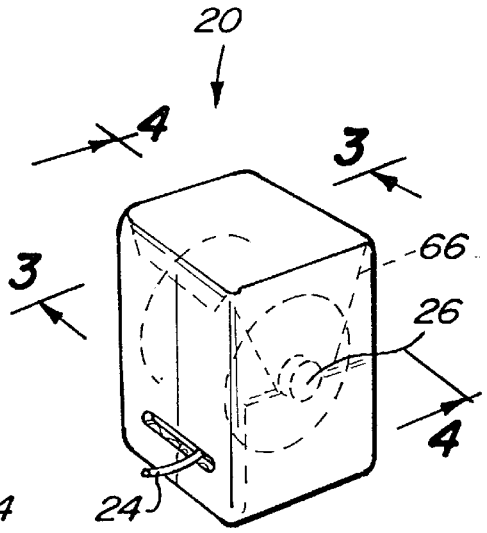
FIG. 2 is a perspective view, fully assembled, of the embodiment shown in FIG. 1.

FIG. 2 shows a fully assembled system 20. To assemble the system, insert 28, and container 30 are first folded from their preformed unitary blanks, as described above. Insert 28 is then positioned in container 30. Spool 22, wound with, for example, wire 24, is then placed over tube 26, and disposed in container 30, wherein tube 26 is received, seated and held in the cradle formed by support notches 48. An end of wire 24 is fed out of payout slot 70, and retaining flap 64, and 66 are folded to the position illustrated by flap 64, and are next moved to the closed position; the trapezoidal-shape of the flaps facilitating movement of retaining flaps 64 and 66 from the open to the closed position.

Figure 3:
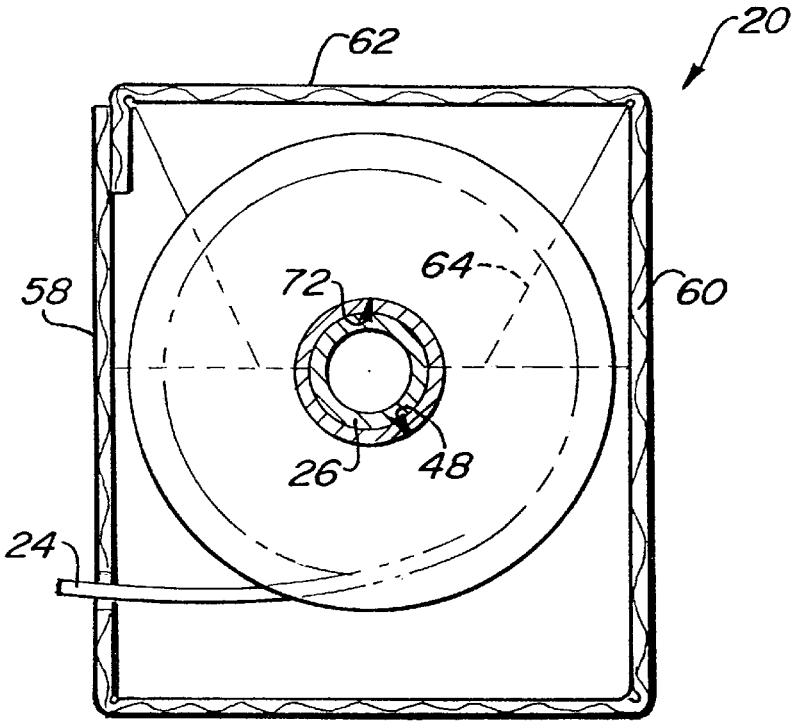
FIG. 3 is a partial, cross-sectional view of the assembled embodiment shown in FIG. 2 taken substantially along lines 3—3.

Referring now to FIG. 3, when closed, retaining flap 66 engages tube 26, thereby also holding insert 28 in place. This arrangement provides for a sturdy packaging system.

Figure 4:
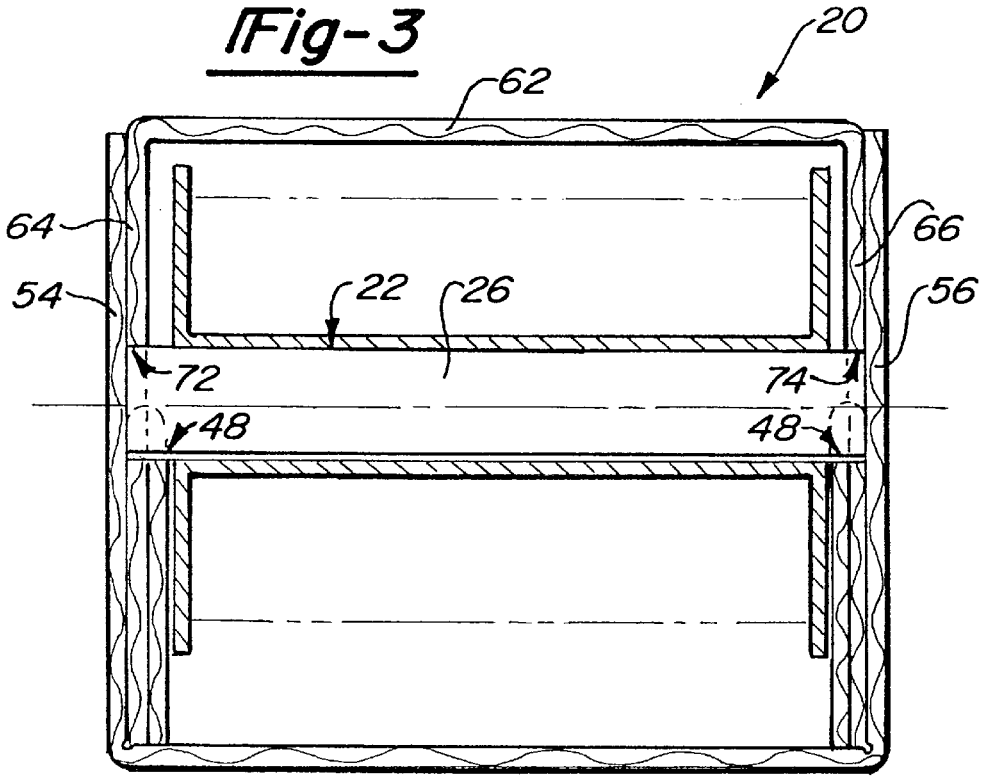
FIG. 4 is a partial, cross-sectional view of the assembled embodiment of FIG. 2 taken substantially along lines 4—4.

FIG. 4 is a cross-sectional view taken substantially along lines 4—4 in FIG. 2, showing how tube 26 is received in notches 48, and is engaged by retaining notches 72 and 74.

Since system 20 includes a container 30, insert 28, and tube 26 that are all made of paper/paper products, the system provides improved recyclability, reduced weight (important to shipping costs), and lower cost than the conventional spool-in-a-box designs.

Figure 5:
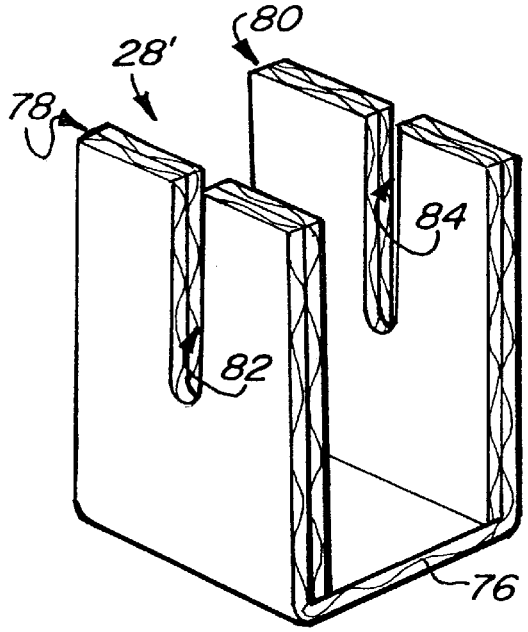
FIG. 5 is a simplified, perspective view of an alternate insert embodiment for use with the system of FIG. 1.

Referring now to FIG. 5, a preferred insert embodiment 28' includes a base portion 76 with a pair of end members 78 and 80 extending vertically from opposing ends of base 76. Insert 28' further includes for each end member 78 and 80, a respective elongated slot 82, and 84, each slot being open at the top. A lowermost portion of each slot is radiused to a size and shape adapted to accommodate and seat tube 26. It should be apparent that the width of slots 82 and 84 must be sufficient to permit tube 26 to pass vertically therethrough. The slots in end members 78 and 80 form a cradle for receiving tube 26.

Figure 6:
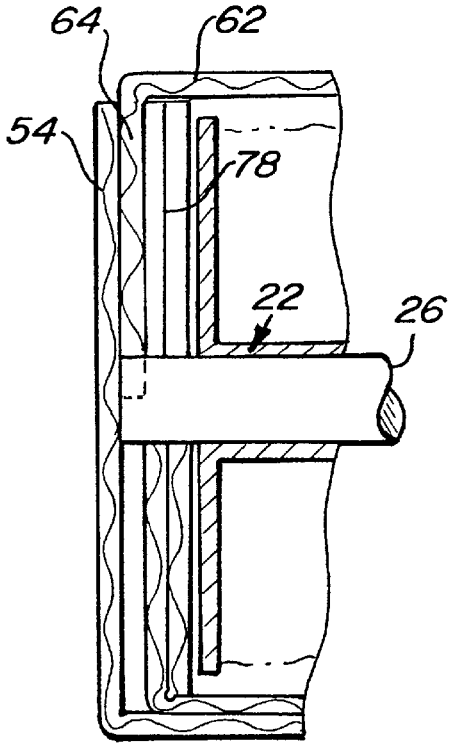
FIG. 6 is a partial, cross-sectional view of a fully assembled alternate embodiment incorporating the insert illustrated in FIG. 5.

Referring now to FIG. 6, insert 28' is of a height substantially equal to the height of container 30 (less the box wall thicknesses of top panel 62 and the bottom panel). In this embodiment, retaining flaps 64 and 66 still engage tube 62, and therefore hold tube 62, and insert 28' in place; however, top panel 62, due to the height of insert 28', substantially engages the top of insert 28'. This feature provides for improved stackability. Insert 28' may be unitary, and folded from a single cardboard blank.

Figure 7:
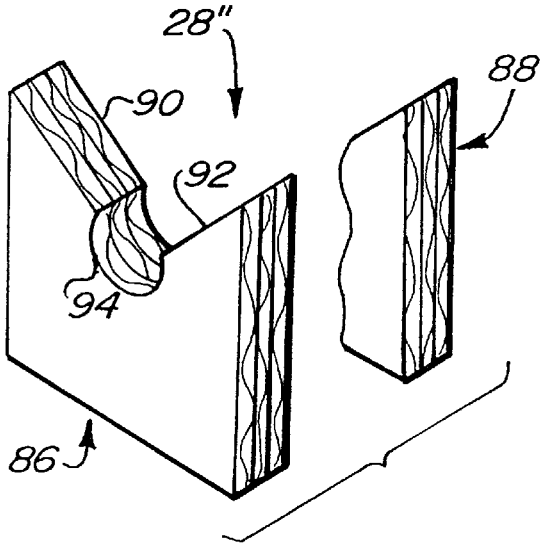
FIG. 7 is a perspective view of yet another alternate insert embodiment suitable for use with the system of FIG. 1.

Referring now to FIG. 7, a third embodiment of the means for receiving and supporting tube 26 is depicted as 28". Means 28" includes a pair of bearing members 86 and 88, each of which may be formed from multiple layers of cardboard (three layer, quadruple-faced cardboard as shown in FIG. 7). Bearing members 86 and 88 are identical; however, only member 86 is shown and will be described in detail for clarity. Member 86 includes a pair of opposing and inwardly tapering surfaces 90 and 92 which have a radius 94 formed on a lowermost portion to thereby define a slot opening upwards. The inwardly tapering surfaces 90, and 92 are provided for guiding the tube 26 to a seated position in radius portion 94 when assembly of the packaging system occurs.

Figure 8:
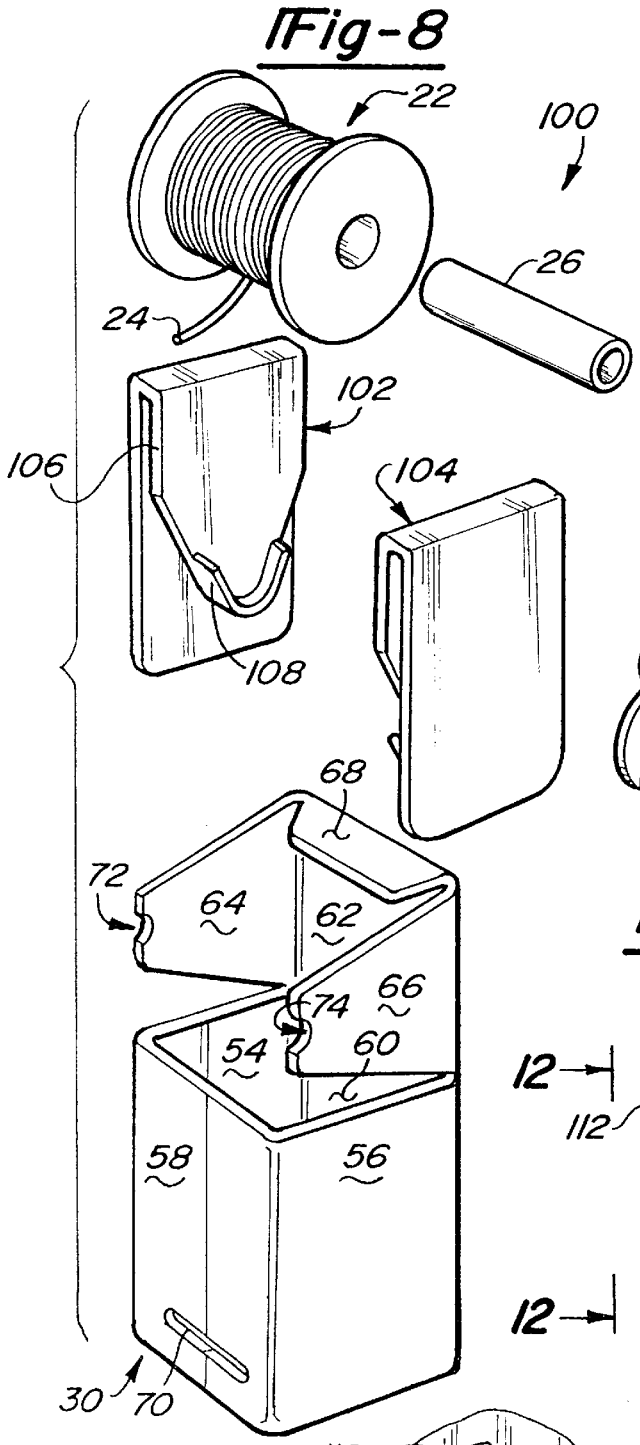
FIG. 8 is a perspective, exploded view of still another embodiment of the present invention, particularly illustrating hanger-type means for supporting the axle and spool.
Figure 9:
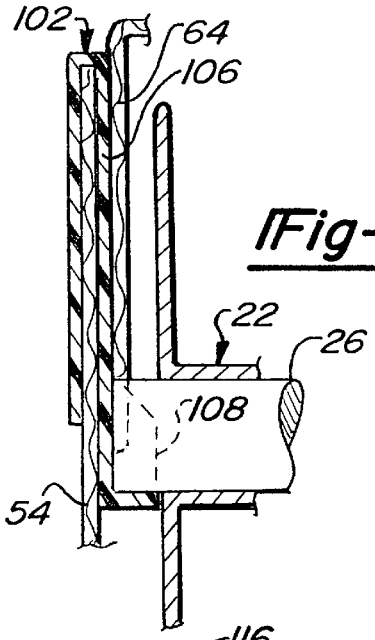
FIG. 9 is a partial, cross-sectional view of the fully assembled embodiment shown in FIG. 8.

FIGS. 8 and 9 illustrate yet another embodiment of the present invention. Referring particularly now to FIG. 8, an improved wire packaging system 100 is illustrated, and which includes an spool 22 wound with wire 24, a tube 26 and a container 30 identical to that illustrated and described above in connection with system 20. The system 100, however, includes means, such as inverted U-shaped hangers 102 and 104, for receiving and supporting tube 26. Each hanger 102 and 104 may be formed of plastic and adapted for straddling opposing sidewalls 54, and 56, respectively, of container 30. The position of hanger 102 when assembled to container 30 is shown in FIG. 9.

As shown in FIG. 9, a lowermost portion of an inwardly disposed side 106 of hanger 102 extends laterally to form a projection 108 for receiving and supporting tube 26. Projection 108 is adapted in size, and shape to correspond to the selected size and shape of tube 26.

Figure 10:
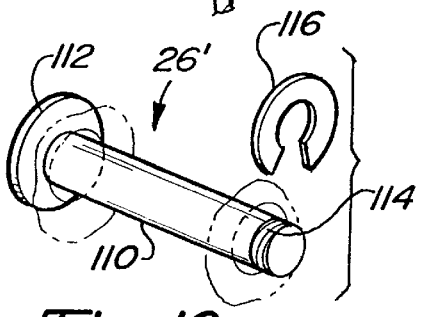
FIG. 10 is a simplified, exploded perspective view of an alternate axle embodiment for use with still yet another alternate embodiment of the present invention.
Figure 11:
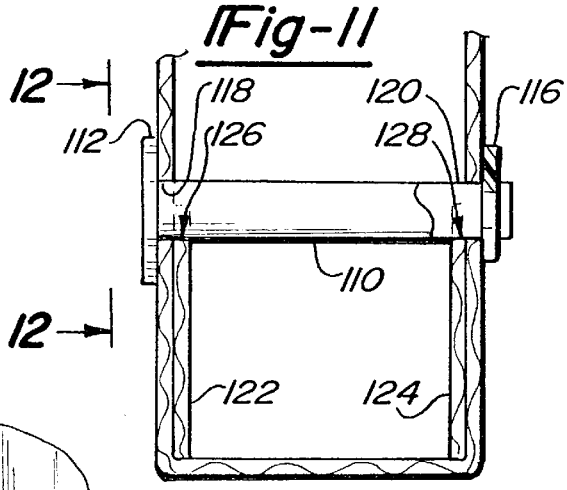
FIG. 11 is a partial, cross-sectional view of a fully assembled embodiment incorporating the alternate axle embodiment shown in FIG. 10.
Figure 12:
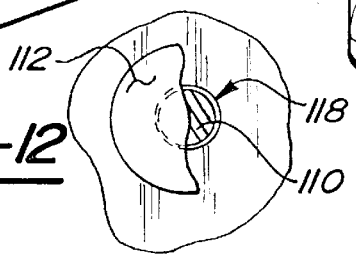
FIG. 12 is a partial cut-away view of a flange portion of the alternate axle embodiment shown in FIG. 10, as viewed substantially in the direction of the arrows indicated at 12—12 in FIG. 11.

FIGS. 10, 11 and 12 show a fifth embodiment in accordance with the present invention. In this embodiment, the installer/end user will insert the axle of the system to obtain spool-in-a-box. In this embodiment, axle 26', as shown in FIG. 10, is preferably employed, and may be made of plastic or fiber. The axle 26' includes a shaft portion 110, a flange portion 112, and a reduced diameter portion 114. A lock washer 116 is also provided for use with axle 26'. Particularly, the reduced diameter portion 114 is adapted in size to cooperate with washer 116 so that washer 116 "snaps" on.

Referring now to FIG. 11, in this fifth embodiment, container 30 is modified to include a pair of removable knock-outs, preferably perforated punch-outs 118 and 120, formed in opposing sidewalls 54, and 56 and sized to allow shaft portion 110 of axle 26 but not flange 112 to pass therethrough. Further, the bottom box flaps of container 30 are modified to obtain a pair of support flaps 122 and 124, which are identical to those on the top of the box (i.e., retaining flaps 64 and 66). Flaps 122, and 124 thus include corresponding notches 126 and 128 to receive and support axle 26'. When a container in this embodiment is assembled (i.e., folded for use), the notches 126, and 128 are in substantial registry with the voids remaining after removal of the perforated punch-outs 118, and 120. The installer/end user would then lift the spool off the bottom of the box, insert axle 26' through punch-outs 118 and 120, and finally place lock washer 116 over reduced diameter portion 114, thus retaining axle 26' in place. In this embodiment, four thicknesses of boxboard support the weight of the spool and wire.

FIG. 12 shows the enlarged flange portion 112, in a partial cut-away view, as seen in the direction of arrows 12—12 in FIG. 11.

The preceding description is exemplary rather than limiting in nature. A preferred embodiment of this invention has been disclosed to enable one skilled in the art to practice this invention. Variations and modifications are possible without departing from the purview and spirit of this invention; the scope of which is limited only by the appended claims.

What is claimed is:

1. A wound material storage and payout system for use with a spool having a through-bore, the system comprising:

an axle for rotatably mounting the spool during payout, the axle comprising a shaft sized to accommodate the through-bore of the spool and a flange located at a first end of the shaft;

a container comprising a pair of opposing side walls having removable knockouts formed thereon, the removable knockouts sized to allow the shaft of the axle but not the flange to pass therethrough;

the container further comprising a pair of support flaps, each of the support flaps having a free end and a fixed end, the free end having a notch formed thereon for supporting the axle and the fixed end being bendable about a line for folding each of the support flaps against the pair of opposing side walls so that the removable knockouts and the notch formed on the free end of each of the support flaps are in substantial registry and define a cradle for supporting the axle following removal of the knockouts;

the container further comprising a payout slot for dispensing wound material from the spool, and a pair of retaining flaps, each of the retaining flaps having a free end, the free end of the retaining flaps having a notch formed thereon for engaging the axle during payout of the wound material.

2. The system of claim 1 wherein each of the retaining flaps has a generally trapezoidal shape.

3. The system of claim 1 wherein each of the support flaps has a generally trapezoidal shape.

4. The system of claim 1 wherein the container and the axle are made from paper products.

5. The system of claim 1 wherein the axle includes a reduced diameter portion at a second end opposite the first end of the shaft for retaining a lock washer.

* * * * *